United States Patent [19]

Bankel et al.

[11] Patent Number: 4,942,816

[45] Date of Patent: Jul. 24, 1990

[54] SAFE-AND-ARM DEVICE FOR THE FUZE OF A SPIN-STABILIZED PROJECTILE

[75] Inventors: Adolf Bankel, Uttenreuth; Hans Strauss, Reichenschwand; Stephan Kerk, Schnaittach, all of Fed. Rep. of Germany

[73] Assignee: Diehl GmbH & Co., Nuremberg, Fed. Rep. of Germany

[21] Appl. No.: 408,141

[22] Filed: Sep. 15, 1989

[30] Foreign Application Priority Data

Sep. 20, 1988 [DE] Fed. Rep. of Germany ..... 3831862

[51] Int. Cl.[5] ..... F42C 15/26

[52] U.S. Cl. ..... 102/235; 102/245; 102/251

[58] Field of Search ..... 102/235, 236, 231, 237, 102/244, 245, 253, 251, 252

[56] References Cited

U.S. PATENT DOCUMENTS

| | | | |
|---|---|---|---|
| 3,595,169 | 7/1971 | Ziemba | 102/235 |
| 3,608,494 | 9/1971 | Ziemba | 102/235 |
| 4,480,551 | 11/1984 | LoFiego | 102/245 |
| 4,691,635 | 9/1987 | Winterhalter et al. | 102/251 |

FOREIGN PATENT DOCUMENTS

| | | |
|---|---|---|
| 0068534 | 5/1983 | European Pat. Off. . |
| 2009988 | 3/1969 | Fed. Rep. of Germany . |
| 2539750 | 9/1975 | Fed. Rep. of Germany . |

*Primary Examiner*—David H. Brown

*Attorney, Agent, or Firm*—Scully, Scott, Murphy & Presser

[57] ABSTRACT

A safe-and-arm or securing device for the fuze of a spinning or spin-stabilized projectile which includes a fuze member and a supporting member in which a spherical rotor is rotatably supported, and which has a radial groove formed therein. The rotor possesses a bore having a detonator inserted therein, and in a peripheral region incorporates a groove which extends along a plane which is axially offset relative to the radial groove, and with a spreadable or expandable restraining medium being inserted into the groove. The restraining medium releases the rotor which is retained in its secured position only subsequent to the firing of the projectile through the securing element which is spreadable and axially displaceable under the effect of axial and spin forces and which allows the rotor, after its release, to be pioted in conjuction with the detonator into the armed position.

3 Claims, 2 Drawing Sheets

SAFE-AND-ARM DEVICE FOR THE FUZE OF A SPIN-STABILIZED PROJECTILE

BACKGROUND OF THE INVENTION

1. Field of the Invention

The present invention relates to safe-and-arm or securing device for the fuze of a spinning or spin-stabilized projectile which includes a fuze member and a supporting member in which a spherical rotor is rotatably supported, and which has a radial groove formed therein. The rotor possesses a bore having a detonator inserted therein, and in a peripheral region incorporates a groove which extends along a plane which is axially offset relative to the radial groove, and with a spreadable or expandable restraining medium being inserted into the groove. The restraining medium releases the rotor which is retained in its secured position only subsequent to the firing of the projectile through the securing element which is spreadable and axially displaceable under the effect of axial and spin forces and which allows the rotor, after its release, to be pivoted in conjunction with the detonator into the armed position.

2. Discussion of the Prior Art

From the disclosure of German Laid-Open Patent Appln: 20 09 988 there is disclosed a rotor securing or safe-and-arm device for the fuze of a spin-stabilized projectile. For effectuating the arming thereof it is necessary to provide for a firing acceleration as well as for the spin. The forces which result therefrom are exerted against a U-shaped expandable restraining ring. The restraining ring is seated in an annular or ring-shaped recess in the rotor. The sliding plane for the restraining ring is of a castellated configuration in the direction extending towards the rotor center. As a consequence thereof, the restraining ring is adapted to assume a forward position which is offset relative to a radial groove facing towards a housing.

Malfunctions can be readily encountered as a result of the non-uniform or uneven weight distribution of the U-shaped restraining ring. The firing acceleration and the spin can tilt the restraining ring in the radial groove facing the housing to such an extent during the rearward and opening displacement, that the arms will hinder the rotor from assuming the spin which is necessary for the functioning.

Furthermore, during rough handling of the projectile, as a result of an unintentional impact the restraining ring can clamp or jam in its rearward position and arrest the rotor in the secured or safe position. In both instances there are then encountered highly-explosive duds subsequent to firing.

From the disclosure of German Pat. No. 25 39 750 it has become known, for a fuze of a spin-stabilized projectile, to provide a clamp-like securing element as the safe-and-arm or securing device for a rotor, and which is constituted of two radially curved arms which are interconnected through a curvilinear web or connector. The curvilinear or arched connector allows for a continual and uniform deflection of the two arms at a specified projectile spin. The action of the safe-and-arm device is only directed towards dependence upon the projectile spin. There is no provision of any arming criteria for the firing impulse.

SUMMARY OF THE INVENTION

Accordingly, it is an object of the present invention to provide, for the fuze of a spin-stabilized projectile, a rotor securing or safe-and-arm device which is constituted from only a few components which will dependably function upon the firing of the spin-stabilized projectile, in which the rotor is released and which, even after rough handling, will facilitate the resecuring of the rotor.

The foregoing object is achieved through the intermediary of a safe-and-arm device, as described in further detail hereinabove, in that in the secured position of the rotor, the restraining ring contacts against an end surface of an annular groove through a conical centering mandrel or taper plug arranged on a side of a housing, wherein the restraining ring possesses an internal conical surface in conformance with the centering mandrel and is in contact by means of an external conical surface with an internal conical surface on the housing, and in that the restraining ring possesses a generally wedge-shaped groove profile with internal, uniformly-distributed supporting tongues and support surfaces and an outer ring which is provided with a slot and possesses a plurality of permanently deformable connectors having the same cross-section, and wherein the restraining ring possesses an annular gap facing towards the bottom of the annular groove.

Of importance to the invention is the presence of the restraining ring which contacts against the rotor under a radial prestressing and which, through its conical seating on the centering mandrel, positions the rotor in the fuze housing in a close-fitting or force-transmissive manner.

The restraining ring allows for the resecuring of the rotor, for example, under dropping or bombing test with reduced requirements of up to about 6,000 g, or under impact forces encountered during the handling of a projectile.

The almost closed restraining ring supports the rotor in a radial direction against the fuze housing. In the presence of lateral or sideways-acting shock loads, the forces from the mass of the rotor are deflected from the restraining ring into the fuze housing. Disadvantageous deformations of the restraining ring cannot occur due to its relatively high moment of resistance. However, such deformations cannot be avoided in the U-shaped restraining ring pursuant to German OS 20 09 998 because of its essentially lower moments of resistance in the longitudinal direction thereof. A deformation of that kind in the known restraining ring can lead to the condition that the rotor will not be released or armed, notwithstanding the existing releasing criteria.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 1:
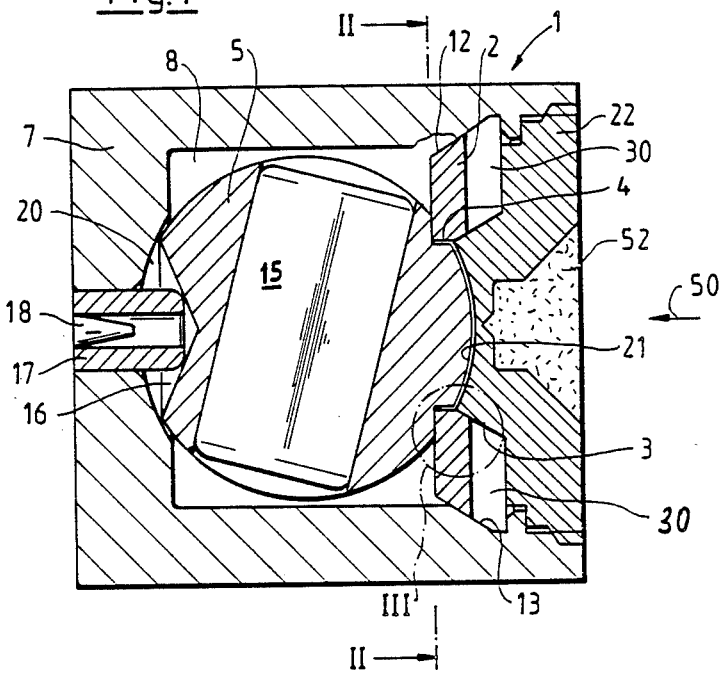
FIG. 1 illustrates a cross-sectional view through a fuze.

A securing or safe-and-arm device 1 contemplates the positioning of a restraining ring 2 on a conical taper plug or centering mandrel 3 within a conical annular space 30 in a fuze housing 7.

The restraining ring 2 is seated resiliently prestressed on the centering mandrel 3 and presses a spherical rotor 5 at an end surface 11 thereof into a spherical expanse or recess 20 within a bore 8 in the fuze housing 7.

The rotor 5 possesses a detonator 15, an annular groove 4 incorporating the end surface 11 and a bottom 10, as well as a fixing or holding cone 16 for a securing sleeve 17. An annular gap 19 is located between the bottom 10 and the restraining ring 2.

Figure 2:
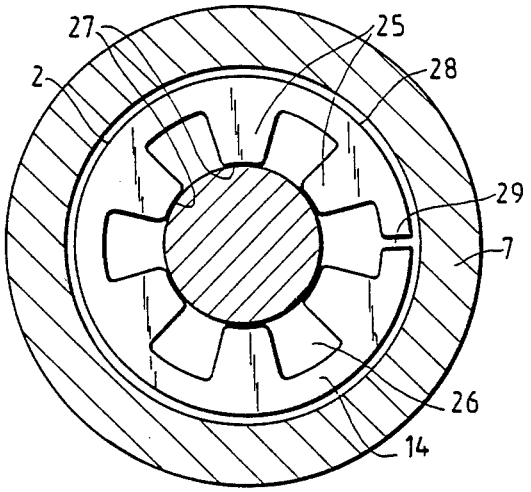
FIG. 2 illustrates a sectional view taken along line II—II in FIG. 1.

The restraining ring 2 is provided with an inner conical surface 9, a radial surface 51 and with an outer conical surface 12. The ring is resiliently prestressed due to a slot 29 (FIG. 2). Pursuant to FIG. 2, the ring possesses a plurality of wedge-shaped profiled cutouts spaced about its circumference, as a result of which there are formed radially inwardly extending supporting tabs or tongues 25 with cutouts 26 arranged so as to provide connectors 14 therebetween. The supporting tongues 25, in conformance with the annular groove 4, each possess curved supporting surfaces 27. A ring-shaped portion 28 of the restraining ring 2 consists of the radially outer portions of the supporting tongues 25 and the connectors 14 which are interposed between the tongues 25 the, and with the ring 28 being cut support through by a slot 29 at the location of one of the connectors 14. The restraining ring 2 consists of a ductile material with a certain initial elasticity in conformance with the width of the slot 29 (FIG. 2) and a high resistance to rupture or tensile strength. Suitable materials therefore are beryllium, aluminum and steel and various metal alloys, such as beryllium-bronze.

Figure 4:
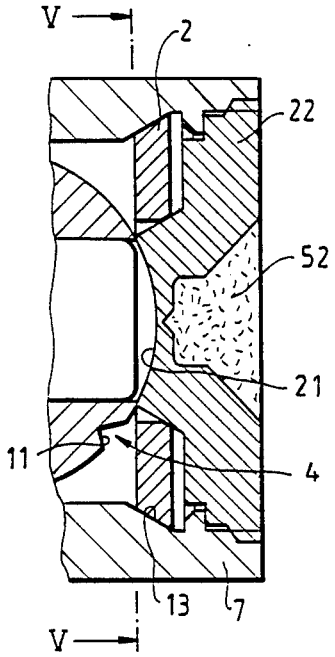
FIG. 4 illustrates the fuze pursuant to FIGS. 1 and 2 during the pick-up of spin in a weapon barrel.
Figure 3:
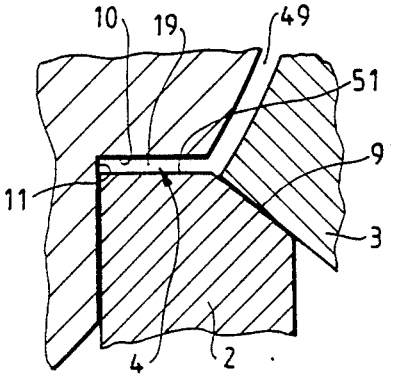
FIG. 3 illustrates, on an enlarged scale, a detail from the encircled portion III in FIG. 1.

The function of the inventive device is now described as follows:

The securing or safe-and-arm device 1 of a spin-actuated fuze (not shown) reacts to the firing acceleration, which is effective in the direction of arrow 50, through an axial movement or displacement of the restraining ring 2 into the position shown pursuant to FIG. 4.

The restraining ring 2 is constituted from a material such as beryllium-bronze. This material facilitates that, as a consequence of the centrifugal forces, it will come into complete contact with the conical surface 13. Thereby, the connectors 14 which extend between the support tongues 25 are plastically; in essence, permanently deformed.

The rotor 5 which is released from the restraining ring 2, due to the location of its center of gravity, orients itself into the position which is ascertainable from FIG. 4, whereby the securing sleeve 17 is pushed back by the fixing cone 16. The spherical recesses 20, 21 serve as slide bearings. The rotor 5 is arrested in the armed position which is ascertainable from this figure through suitable means which are not illustrated herein.

When a detonating criterium is present, the firing pin 18 then strikes in a known manner against the detonator 15. The ignition energy of the latter then triggers a transmitting charge 52. During a dropping test or during rough handling, when a shock is exerted against the safe-and-arm device 1 in accordance with the direction the arrow 50, the restraining ring 2 resultingly move somewhat away from the rotor 5 and; however, subsequent to the shock will again resume its position on the rotor 5 as a result of its inherent spring force, as can be ascertained from FIG. 1.

The securing sleeve 17 allows for the rotor 5 to remain in the secured position pursuant to FIG. 1 during the phase in which the restraining ring 2 is lifted away from the rotor 5.

Figure 5:
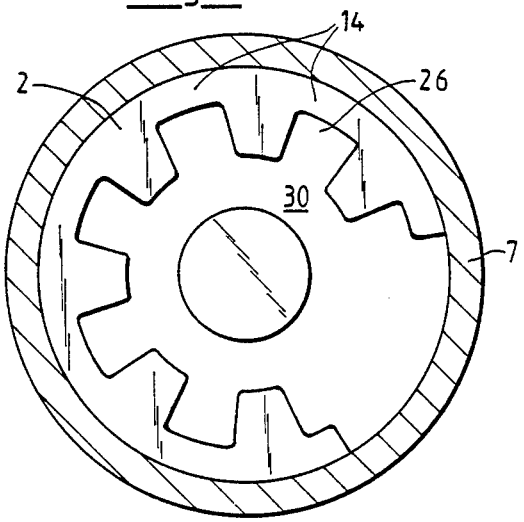
FIG. 5 illustrates a sectional view taken along line V—V in FIG. 4.

When a spin is exerted on a projectile during the acceleration thereof within a weapon barrel, whereby the spin does not attain the prescribed magnitude; for example, with a weapon barrel which is almost worn out from firing, then subsequent to the exit of the projectile from the weapon barrel there is provided the presence of a rotor 5 which is again secured. The centrifugal forces which are exerted on the restraining ring 2 have not reached the magnitude for plastically deforming the connectors 14, as shown in FIG. 5, so that the restraining ring 2 will have maintained its unchanged size pursuant to FIGS. 1 and 2.

Also of advantage is the resilient support of the rotor through intermediary of the restraining ring 2. This causes the formation of a gap 49, in that the rotor 5 is pressed into the recess 20 in the fuze housing 7. Upon the encounting of shock loads there is thus imparted to the rotor 5 the possibility of a spring-dampened displacement in support thereof within the bore. Thereby, the triggering threshold for the detonator 15 when subjected to shock loads is substantially lower than for detonators pursuant to the state-of-the-technology. Other suitable materials for the restraining ring 2 are aluminum or steel. The required material properties are a high resistance to fracture and a high degree of ductility or tensile strength.

What is claimed is:

1. A safe-and-arm device for a fuze for a spin-stabilized projectile; comprising a supporting housing for said fuze; a spherical rotor being rotatably supported within the supporting housing, a radial groove formed in said supporting housing, said rotor having a bore; a detonator inserted in said bore; an annular groove in a peripheral region of said rotor extending in a plane axially offset relative to said radial groove, a spreadable restraining means inserted in said rotor groove for saving the rotor which is retained in a secured position only prior to firing of the projectile through the spreadable restraining means which are axially displaced and spread apart only subsequent to firing of the projectile responsive to axial and spin forces, and said spreading facilitating pivoting of the rotor with the detonator into the armed position after release thereof, said restraining means being a restraining ring contacting an end surface of the annular groove in said rotor through a conical centering mandrel on the fuze housing in the secured position of said rotor, said restraining ring having an inner conical surface conforming with the centering mandrel and an outer conical surface contacting an inner conical surface on the housing, said restraining ring having a plurality of substantially wedge-shaped groove profiles spaced about the circumference thereof forming radially inwardly extending supporting tongues and supporting surfaces, and including an outer ring structure incorporating a plurality of permanently deformable connectors of similar cross-sections intermediate said tongues, said ring structure having a slot cut therethrough, and said restraining ring forming an annular gap facing the bottom of the annular groove.

2. Safe-and-arm device as claimed in claim 1, wherein the restraining ring, in the secured position of the rotor, is seated on said centering mandrel resiliently-prestressed in a centripetal direction.

3. Safe-and-arm device as claimed in claim 1, wherein, during arming, said radial groove is a conical annular space positioning the spread restraining ring in the fuze housing.

* * * * *